United States Patent [19]

Bezusko et al.

[11] Patent Number: 4,497,532

Date of Patent: Feb. 5, 1985

[54] HEAT SHIELDED, SPARK PLUG BOOT ASSEMBLY

[75] Inventors: Michael J. Bezusko; Daniel P. Liska; Joseph A. McGee, all of Warren, Ohio

[73] Assignee: General Motors Corporation, Detroit, Mich.

[21] Appl. No.: 545,359

[22] Filed: Oct. 25, 1983

[51] Int. Cl.[3] ..... H01R 13/533; H01R 13/658

[52] U.S. Cl. ..... 339/112 R; 339/136 C; 339/143 C

[58] Field of Search ..... 339/26, 112 R, 136 C, 339/140 S, 143 C, 143 S, 213 S

[56] References Cited

U.S. PATENT DOCUMENTS 2,069,046 1/1937 Rabezzana ..... 339/143 S X
3,128,139 4/1964 Estes ..... 339/26
3,178,661 4/1965 Kirchgessner ..... 333/79

FOREIGN PATENT DOCUMENTS 723590 2/1955 United Kingdom ..... 339/136 C

*Primary Examiner*—Eugene F. Desmond
*Attorney, Agent, or Firm*—F. J. Fodale

[57] ABSTRACT

A heat shielded, spark plug boot assembly comprises an elastomeric boot and an electrically grounded heat shield. The heat shield has a thin inner dielectric barrier which is configured to protect against electrical discharges through the thinner vulnerable portions of the elastomeric boot and to be bypassed by corona conduction from the elastomeric boot to the metal shell of the heat shield. The elastomeric boot is ribbed to provide air flow passages between the elastomeric boot and the heat shield.

5 Claims, 8 Drawing Figures

HEAT SHIELDED, SPARK PLUG BOOT ASSEMBLY

This invention relates generally to an electrical connector for automotive ignition cables and, more particularly, to a spark plug boot which is attached to the end of an ignition cable for covering and protecting the electrical connection of the ignition cable to the spark plug.

For many years, it has been customary to attach an elastomeric boot to the end of an ignition cable for covering and protecting the electrical connection of the ignition cable to the spark plug, as shown for example in the U.S. Pat. No. 3,128,139 granted to Stanley E. Estes on Apr. 7, 1964. The Estes patent also illustrates a metal shield 13 which surrounds the elastomeric boot 20 and is grounded to metal base 14 of the spark plug 11 by a spring clip 29. The purpose of the metal shield 13 is to provide an electric shield for suppressing radio frequency interference of the automotive ignition system.

The advent of T.V.R.S. (Television-Radio-Suppressor) cable having a nonmetallic conductor core has eliminated the need for an electric shield for the ignition cable and the spark plug boot.

However, a new need has arisen for a heat shield for the spark plug boot because the operating temperatures in engine compartments have risen sharply in the last few years and spark plugs are often located near the engine exhaust manifold or other hot spots in the engine compartment. The high temperatures in such locations deteriorate and shorten the useful life of elastomeric spark plug boots, even when high temperature elastomers, such as silicone, are used.

It is already known that the temperature capability of an elastomeric boot can be increased by the use of a metal heat shield (similar to the electric shield disclosed in the Estes patent) which dissipates the heat from any close hot spots in the engine compartment and tends to uniformly distribute the heat around the elastomeric boot. These metal heat shields also contact the metal base of the spark plug to transfer heat to the massive and cooler engine block for enhanced heat shielding effectiveness.

Such metal heat shields, however, have a major drawback in that the metal heat shield also provides an electrical ground plane in close proximity to the electrical connection of the ignition cable to the spark plug inside of the elastomeric boot. This close proximity is particularly troublesome in the case of high energy ignition systems which operate at approximately 35,000 volts.

In such a case, the dielectric strength of the elastomeric boot may eventually be exceeded resulting in electrical discharges from the mating ignition cable and spark plug terminals to the electrically grounded metal heat shield through the elastomeric boot. Such electrical discharges erode the elastomeric boot and eventually destroy its usefulness as a protective covering for the electrical connection of the ignition cable to the spark plug. The elastomeric boot is particularily vulnerable in the intermediate cavity portion which houses the high voltage connection in close proximity to the metal heat shield and in the seal end portion which embraces the ceramic insulator of the spark plug, both of which are relatively thin for functional purposes.

The object of this invention is to provide a compact heat shielded, spark plug boot assembly having an electrically grounded metal heat shield in which the adverse effects of a ground plane in close proximity to the elastomeric spark plug boot are substantially reduced or eliminated.

A feature of the invention is that the metal heat shield has a thin inner dielectric barrier which increases the dielectric strength of the assembly sufficiently to prevent troublesome electrical discharges through the elastomeric boot while avoiding any need for increasing the thickness of the elastomeric boot.

Another feature of the invention is that the thin inner dielectric barrier is configured to protect against discharges through the cavity and spark plug seal areas of the elastomeric boot which are particularly vulnerable to erosion.

Yet another feature of the invention is that the inner dielectric barrier is configured so that any corona discharge to the electrically grounded metal heat shield bypasses the inner dielectric barrier to prevent corona erosion of the inner dielectric barrier.

Still another feature of this invention is the provision for convection cooling by air flow between the heat shield and the elastomeric boot.

Still another feature in connection with a second embodiment of this invention is a very economical metal foil heat shield which is reversible for ease of assembly to the elastomeric boot.

Other objects and features of the invention will become apparent to those skilled in the art as the disclosure is made in the following detailed description of a preferred embodiment of the invention as illustrated in the accompanying sheets of drawing in which.

Figure 1:
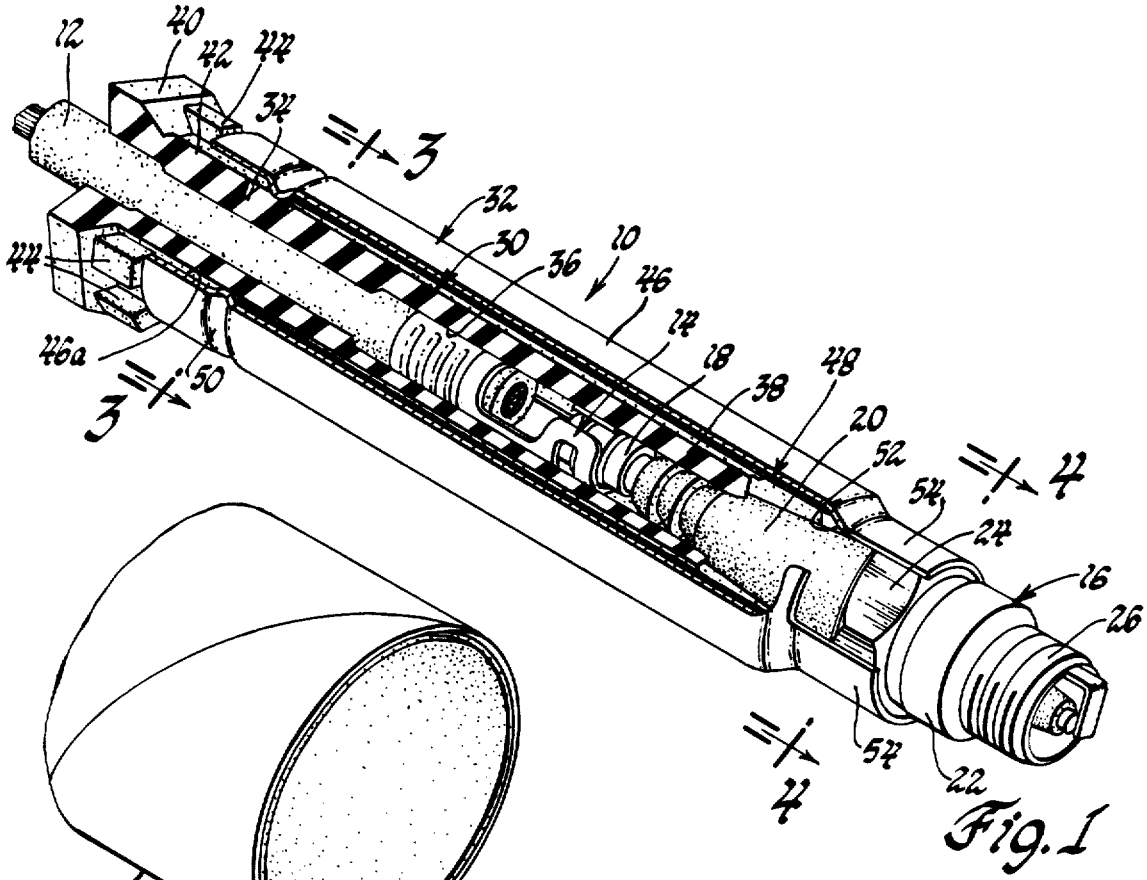
FIG. 1 is a cut away perspective view of a heat shielded, spark plug boot assembly for a spark plug connector in accordance with a first embodiment of this invention.

Referring now to the drawing and, more particularly, to FIG. 1, a heat shielded, spark plug boot assembly 10 in accordance with a first embodiment of our invention is illustrated in conjunction with an ignition cable 12, a socket terminal 14 and a spark plug 16.

The ignition cable 12 is a high energy T.V.R.S. cable which has a nonmetallic conductive core and a high temperature silicone insulation jacket. The socket terminal 14 is attached to the end of the ignition cable by a conventional strip and fold technique and may be of any suitable design for connection to the spark plug 16.

The spark plug 16 is likewise of conventional design and standard configuration. It comprises a stud terminal 18 which plugs into the socket terminal 14, a ceramic insulator 20 and a metal base 22 having a hex head 24 and a threaded shank 26 by means of which the spark plug 16 is screwed into an engine block (not shown).

The heat shielded, spark plug boot assembly 10 comprises an elastomeric spark plug boot 30 of elongated tubular shape and a heat shield 32. The elastomeric boot 30 has a cable end portion 34, an intermediate cavity portion 36 and a seal end portion 38. The cable end portion 34 has a bore which is sized so as to sealingly engage around the silicone jacket of the ignition cable 12. The bore of the intermediate cavity portion 36 is somewhat larger to provide room for the socket terminal 14 attached to the end of the ignition cable 12. The bore of the seal end 38 is sized to sealingly engage around the ceramic insulator 20 of the spark plug 16 as shown in FIG. 1.

Figure 3:
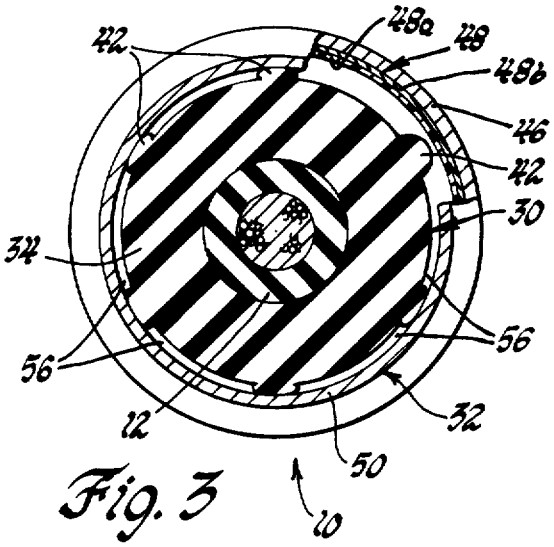
FIG. 3 is a section taken substantially along the line 3—3 of FIG. 1 looking in the direction of the arrows.
Figure 4:
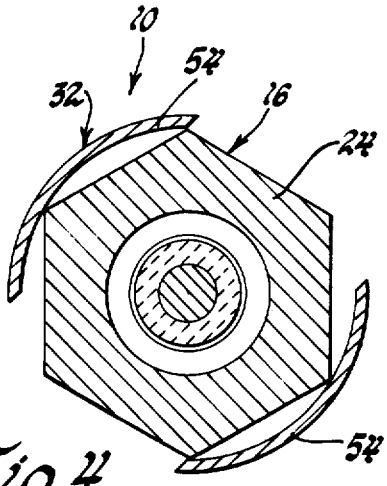
FIG. 4 is a section taken substantially along the line 4—4 of FIG. 1 looking in the direction of the arrows.

The spark plug boot 30 has a hexagonal head 40 at the cable end which serves as a finger grip for connecting and disconnecting the assembly 10 to the spark plug 16. The outside of the boot 30 has a plurality of integral circumferentially spaced longitudinal ribs 42. These ribs extend from the head 40 to the seal end of the boot 30 as shown in FIG. 1. The integral ribs 42 are semicircular in cross section as shown in FIG. 3. The boot 30 also has a number of integral stop lugs 44 which are integrally attached to the head 40 and a respective one of the ribs 42. The outer periphery of the boot 30 (including the ribs 42 and the portion therebetween) tapers slightly in the longitudinal direction from the cable end to the seal end so as to facilitate insertion into the heat shield 32.

Figure 2:
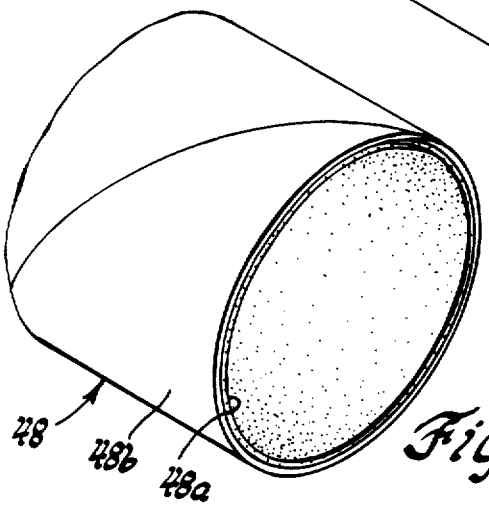
FIG. 2 is a cut away perspective view of a dielectric barrier used in the assembly shown in FIG. 1.

The heat shield 32 comprises an outer metal shell 46 and an inner dielectric barrier 48. The inner dielectric barrier 48, as illustrated in FIG. 2, is a thin, spiral wound roll of high temperature dielectric material. We have found that a laminate consisting of an inner Kapton film layer 48*a* of 0.08 millimeters (3 mils) thickness and an outer Nomex paper layer 48*b* of 0.05 millimeters (2 mils) thickness is suitable. Kapton is the trademark for the polyimide films of DuPont, while Nomex is their trademark for heat resistant aromatic polyamide fibers.

It is also possible to use other high temperature dielectric films, such as Teflon and Mylar. Teflon is the DuPont trademark for polytetrafluoroethylene while Mylar is the DuPont trademark for their polyester.

It is likewise possible to use spray and powder coatings of high temperature dielectric materials such as Ryton, epoxy, silicone, fluoropolymers and enamels which can be applied either to a paper layer or directly to the outer metal shell 46. Ryton is the trademark of Phillips Chemical Company for polyphenylene sulfide.

The outer metal shell 46 is preferably made of aluminum for cost and weight savings. The shell 46 has a circumferential bead 50 rolled in the adjacent one end and a reduced diameter portion at the opposite end. The reduced diameter portion forms an internal annular shoulder 52 and is cut to provide longitudinal ears 54 of arcuate cross section.

The inner dielectric barrier 48 fits snugly inside the outer metal shell 46 and extends from the circumferential bead 50 to the annular shoulder 52. The bead 50 and the shoulder 52 retain the dielectric barrier 48 in the longitudinal direction.

The heat shield 32 is longer than the elastomeric boot 30 and it is mounted on the elastomeric boot 30 so that the end adjacent the circumferential bead 50 abuts the stop lugs 44 and the ears 54 are located beyond the seal end of the elastomeric boot 30 to engage the hex head 24 of the spark plug base 22. The heat shield 32 is retained on the elastomeric boot 30 by the interference fit of the circumferential bead 50 on the longitudinal ribs 42.

The inner dielectric barrier 48 extends from the circumferential bead 50 to the annular shoulder 52 of the metal shell 46 which is well past the seal end of the elastomeric boot 30. Commencement of the inner dielectric barrier 48 at the circumferential bead 50 provides a path for corona discharge to the electrically grounded outer metal shell 46 via the exposed inner surface 46*a*. In this area of the assembly, the dielectric strength of the elastomeric boot 30 is maximum and, consequently, the close proximity of the grounded inner surface 46*a* is not a problem. However, the conduction of corona from the elastomeric boot 30 to the metal shell 46 by a path around the dielectric barrier 48 is significant because corona discharge through the dielectric barrier 48 can cause corona erosion and dramatic loss in dielectric strength of the dielectric barrier 48.

Due to the compression set characteristics inherent in elastomeric materials used in spark plug boots, the dielectric strength of the seal end 38 of the boot 30 is reduced significantly with age and exposure to heat and servicing requirements. Consequently, the inner dielectric barrier 48 extends past the elastomeric boot 30 to the shoulder 52 to decrease the proximity of the grounded metal shell 46 to the seal end 38.

This extension of the inner dielectric barrier 46 to the shell shoulder 52 prevents electrical discharges through the seal end poriton 38 and the consequent erosion thereof. However, the termination of the dielectric barrier 48 at the shell shoulder 52 is equally important as it provides an exposed inner surface 46*b* of the metal shell 46 for the conduction of corona from the seal end of the boot 30 to the grounded metal shell 46 by a path around rather than through the dielectric barrier 48.

The inner dielectric barrier 48 is thus configured to protect against electrical discharges through the thinner vulnerable portions of the elastomeric boot 30, that is, the cavity and seal end portions 36 and 38 while at the same time the barrier 48 is configured to protect itself against corona discharge.

The elastomeric boot 30 and the heat shield 32 are also configured to provide for convection cooling by air flow between the elastomeric boot 30 and the heat shield 32. More specifically, the mounting of the heat shield 32 on longitudinal ribs 42 provides a plurality of longitudinal air flow passages 56 between the respective ribs 42 as best seen in FIG. 3. The spaces between the lugs 44 of the elastomeric boot 30 provide openings for the air flow passages 56 at the upper end of the heat shield 32. The spaces between the heat shield 32 and the spark plug 16 (i.e., the insulator 20 and hex head 23) as well as the spaces between the ears 54 provide a manifolding and porting for the air flow passages 56 from the lower end of the elastomeric boot 30 to the exterior of the heat shield 32.

Figure 5:
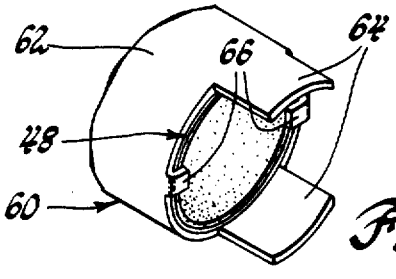
FIG. 5 is a partial perspective view of a modified metal shell which may be used in the assembly shown in FIG. 1.

Referring now to FIG. 5, a slightly modified heat shield 60 is disclosed. The outer metal shell 62 does not have a reduced end for attachment to the hex head of the spark plug. Consequently, the diameter of the arcuate ears 64 is the same as the diameter of the shell 62 and bent tabs 66 are provided between the ears 64 to retain the inner dielectric barrier 48 inside the shell 62. The heat shield 60 is otherwise the same as the heat shield 32.

Figure 6:
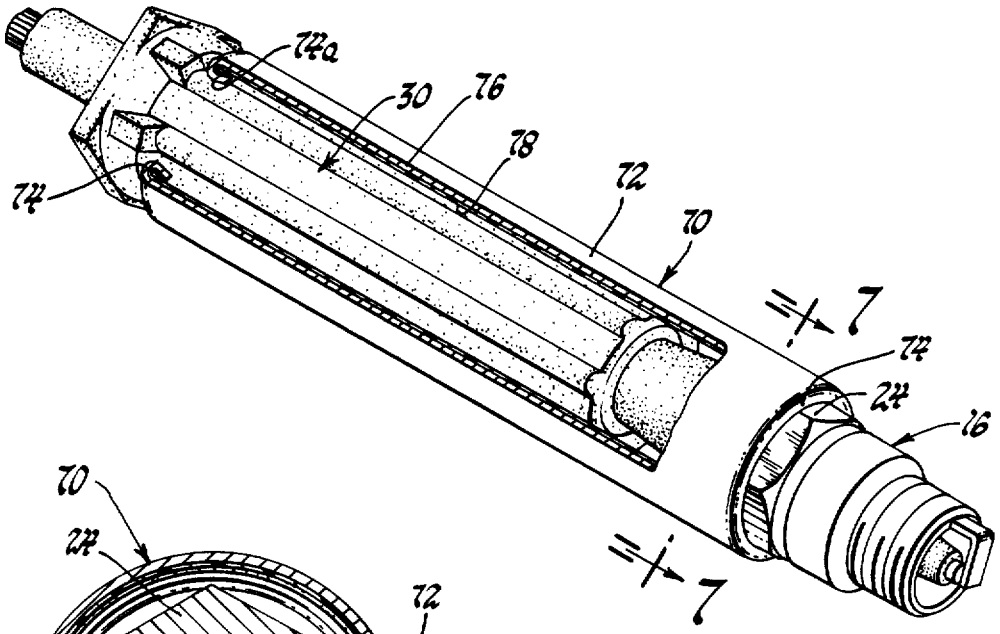
FIG. 6 is a cut away perspective view of a heat shielded, spark plug boot assembly in accordance with a second embodiment of this invention.
Figure 7:
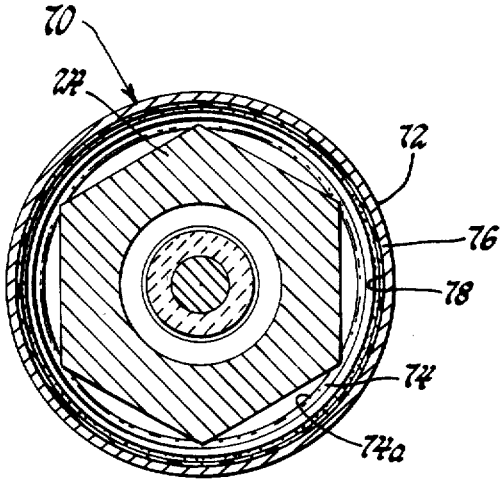
FIG. 7 is a section taken substantially along the line 7—7 of FIG. 6 looking in the direction of the arrows.
Figure 8:
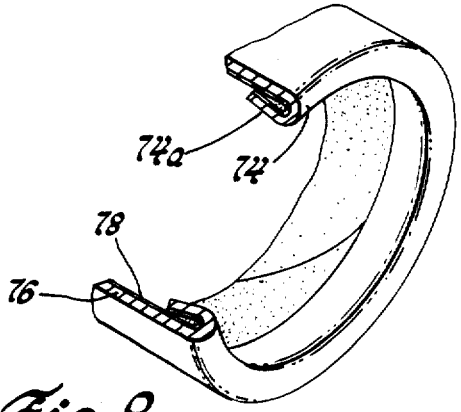
FIG. 8 is an enlargement of a portion of FIG. 6.

Referring now to FIGS. 6–8, another embodiment of a heat shield is shown. The features unique to this embodiment are a very economical foil construction and a reversible configuration for ease of assembly to the elastomeric boot.

The heat shield 70 is a spiral wound laminate tube 72 having each end rolled in to provide an inner circumferential bead 74 at each end. The outer layer 76 of the laminate is an aluminum foil which provides a heat sink and ground plane whereas the inner layer 78 is a Kapton film which provides a dielectric barrier. In practice, we have found that a four layer laminate consisting of three layers of aluminum foil, each 3 mils thick provides a satisfactory "shell" of sufficient physical strength and an inner layer of Kapton film 3 mils thick provides a dielectric barrier of sufficient dielectric strength. However, other combinations are possible.

For instance, the foil layers constituting the "shell" can be varied in number, thickness and metallic material while the dielectric barrier can be made of other films, sprays and coatings as indicated heretofore.

In any event, the circumferential beads 74 at each end provide the exposed inner metal surfaces 74*a* at the respective ends of the inner Kapton layer 78 for corona to discharge around, rather than through, the dielectric barrier. One of the circumferential beads 74 also provides the means for mounting the heat shield 72 on the ribs 42 of the elastomeric boot 30 which is the same as the boot 30 shown in FIGS. 1–4. The other circumferential bead 74 provides the means for grounding the metal "shell" of the heat shield 72 on the hex head 24 of the spark plug 16 which is the same as the spark plug 16 shown in FIGS. 1–4. This construction retains the convection cooling feature as the air flow passages 56 remain and there are still spaces between the circumferential bead 74 and the hex head 24 for porting the interior of the heat shield 72.

Since the heat shield 72 is symmetrical in the longitudinal direction, it can be mounted on the elastomeric boot 30 either end first. This reversibility feature facilitates assembly to the elastomeric boot 30 and the heat shield 72 itself is of very economical construction.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A heat shielded, spark plug boot assembly for an ignition cable connector, comprising, a tubular elastomeric boot having a cable end portion for receiving an ignition cable, an intermediate cavity portion for housing a terminal at the end of the ignition cable, and a seal end portion for receiving a spark plug and sealing around the insulator thereof, and a heat shield which is mounted on the cable end portion of the elastomeric boot and which extends past the seal end portion of the elastomeric boot for engaging a ground member, said heat shield having an outer metal shell and an inner dielectric barrier, said inner dielectric barrier surrounding the cavity and seal end portions of the elastomeric boot and extending past the seal end portion to prevent electrical discharges through the cavity and seal end portions of the elastomeric boot and, said metal shell being formed so as to provide an inwardly facing metal surface at one end of the dielectric barrier for conducting corona around rather than through the dielectric barrier.

2. A heat shielded, spark plug boot assembly for an ignition cable connector, comprising, a tubular elasatomeric boot having a cable end portion for receiving an ignition cable, an intermediate cavity portion for housing a terminal at the end of the ignition cable, and a seal end portion for receiving a spark plug and sealing around the insulator thereof, and a heat shield which is mounted on the cable end portion of the elastomeric boot and which extends past the seal end portion of the elastomeric boot for engaging a metal base of the spark plug, said heat shield having an outer metal shell and an inner dielectric barrier, said inner dielectric barrier surrounding the cavity and seal end portions of the elastomeric boot and extending past the seal end portion to prevent electrical discharges through the cavity and seal end portions of the elastomeric boot, said metal shell being formed so as to provide inwardly facing metal surfaces at the respective ends of the dielectric barrier for conducting corona around rather than through the dielectric barrier, and one of said inwardly facing metal surfaces being located beyond the seal end portion of the elastomeric boot for electrically grounding the metal shell on the spark plug base.

3. A heat shielded, spark plug boot assembly for an ignition cable connector, comprising, a tubular elastomeric boot having a cable end portion for receiving an ignition cable, an intermediate cavity portion for housing a terminal at the end of the ignition cable, and a seal end portion for receiving a spark plug and sealing around the insulator thereof, said spark plug boot having a plurality of circumferentially spaced longitudinal ribs on its outer surface and a plurality of circumferentially spaced stop lugs on the cable end portion which extend outwardly of the longitudinal ribs, and a heat shield which is mounted on the longitudinal ribs against the stop lugs and which extend beyond the seal end portion of the elastomeric boot for engaging a metal base of the spark plug, said ribs providing a plurality of longitudinal air flow passages between the heat shield and the elastomeric boot which are open at one end by virtue of the spaces between the lugs and at the opposite end by virtue of the spaces between the heat shield and the spark plug, said heat shield having an outer metal shell and an inner dielectric barrier, said inner dielectric barrier surrounding the cavity and seal end portions of the elastomeric boot and extending past the seal end portion to prevent electrical discharges through the cavity and seal end portions of the elastomeric boot, and said metal shell having a circumferential bead adjacent one end which secures the heat shield to the elastomeric boot and which provides an inwardly facing metal surface at one end of the dielectric barrier for conducting corona around rather than through the dielectric barrier, and said metal shell having another inwardly facing metal surface at the other end of the dielectric barrier for conducting corona around rather than through the dielectric barrier and for electrically grounding the metal shell on the spark plug base.

4. The heat shielded, spark plug boot assembly as defined in claim 3 wherein the dielectric barrier comprises a thin, spiral wound, laminate roll which is retained longitudinally inside the metal shell by the circumferential bead at one end and by an inwardly directed portion of the shell at the other end.

5. The heat shield spark plug boot arrangement as defined in claim 4 wherein the heat shield is a spirally wound roll of laminated material having both ends rolled in to provide an inner circumferential bead at each end, and said roll has an outer layer or layers of foil which provide the metal shell and an inner dielectric film which provides the dielectric barrier.

* * * * *